United States Patent [19]

Renfroe, Jr.

[11] Patent Number: 4,834,176

[45] Date of Patent: May 30, 1989

[54] WELL VALVE

[75] Inventor: James B. Renfroe, Jr., Valencia, Calif.

[73] Assignee: Otis Engineering Corporation, Dallas, Tex.

[21] Appl. No.: 180,128

[22] Filed: Apr. 11, 1988

[51] Int. Cl.[4] ..... E21B 34/10

[52] U.S. Cl. ..... 166/142; 166/184; 166/317; 166/318; 166/319; 166/374

[58] Field of Search ..... 166/318, 319, 321, 323, 166/324; 251/14, 62, 63, 282, 325; 137/70, 71, 467, 508

[56] References Cited

U.S. PATENT DOCUMENTS

| | | | |
|---|---|---|---|
| 2,988,145 | 6/1961 | Clark, Jr. | 166/319 X |
| 3,572,434 | 3/1971 | Ecuer | 166/319 X |
| 3,981,360 | 9/1976 | Marathe | 166/317 |
| 4,220,206 | 9/1980 | Van Winkle | 166/317 X |
| 4,574,894 | 3/1986 | Jadwin | 166/319 X |

OTHER PUBLICATIONS

General Sales Catalog (OEC 5338), Mar. 1985, Otis Engineering Corporation, P.O. Box 819052, Dallas, Tex. 75381-9052, p. 91.

*Primary Examiner*—Stephen J. Novosad
*Attorney, Agent, or Firm*—Roland O. Cox

[57] ABSTRACT

A sleeve type valve useful in a well tubing string for controlling flow between the valve interior and exterior. An internal pressure balanced sleeve is releasably positioned to the valve body closing a flow port in the valve body wall to flow. The valve has an external pressure unbalanced sleeve also releasably positioned to close the port to flow. When the internal sleeve is moved to a position opening the port to flow, pressure may be increased in the valve interior to act through the port on the unbalanced sleeve, moving this sleeve to a position also opening the port to flow and permitting flow between the valve interior and exterior. The body has profiled grooving and a seal bore above the port and a seal bore below the port in which a locking mandrel may lock and seal, reclosing the port to flow.

21 Claims, 1 Drawing Sheet

WELL VALVE

BACKGROUND OF THE INVENTION

1. Field of the Invention

This invention relates to valves useful in wells and more particularly relates to a sleeve type valve which is adapted for connection into well tubing to control flow between the interior and exterior of the tubing.

2. Background Art

A number of forms of sleeve valves have been used in well tubing to prevent and permit flow between the interior or tubing through the valve and exterior into an annulus formed between tubing and casing in the well.

During well operation, these valves are very useful in tubing above or below a well packer set in the casing. When used above a packer, these valves are known as circulation valves because when open, fluid may be circulated through the well by pumping down the tubing through the valve and up the annulus back to surface. Reverse circulation occurs when the fluid is pumped down the annulus through the valve and up the tubing to surface. Valves of this type used below a packer in a closed tubing string are known as production valves because when open, production may flow from the annulus below the packer through the valve into the tubing and to surface.

An example of a reverse circulation valve is shown in U.S. Pat. No. 3,193,016 to Granville S. Knox. This valve is opened to permit reverse circulation by increasing pressure exterior of the valve in a well annulus. The valve is biased to the closed position and cannot be opened for regular circulation by increasing pressure in the tubing.

Valves useful in well tubing to control flow between the tubing interior and exterior are Sliding Side Door ® Circulation/Production Devices shown on page 136 and page 276 of the "General Sales Catalog" OEC 5338, published by Otis Engineering Corporation, P. O. Box 819052, Dallas, Tex. 75381-9052. These valves are mechanically opened and closed by a shifting device which moves an inner sleeve between open and closed positions.

SUMMARY

The valve of this invention includes a body adapted to be connected in a well tubing string having at least one wall flow port. Inside a body a longitudinally moveable sleeve is releasably positioned to seal on equal diameters above and below the flow port, closing the port to flow from the body interior. Outside on the body is a longitudinally moveable external sleeve releasably positioned to seal above the flow port on a larger body diameter and below the flow port on a smaller body diameter, closing the port to flow from exterior of the body. Pressure surges or increases inside the body do not urge the internal sleeve to move as it is sealed on equal diameters or "balanced". When the internal sleeve is released and moved downwardly opening the port to flow from the body interior into the external sleeve, internal pressure in the valve body may be increased to act on the unbalanced area of the external sleeve to release and move the external sleeve downwardly opening the port to flow between the interior and exterior of the valve body. The body has profiled grooving and a seal bore above the port and a seal bore below the port in which a lock mandrel may later seal and lock across the open port again closing the port to flow.

An object of this invention is to provide a valve useful in well tubing as a circulation valve or a production valve.

An object of this invention is to provide a valve useful in well tubing which cannot be prematurely opened by increased pressure or pressure surges in the valve body.

Another object of this invention is to provide a valve useful in well tubing as a circulation or production valve which can be opened for flow between the valve interior and exterior after moving an internal sleeve to open position and increasing pressure in the valve interior.

Also an object of this invention is to provide a circulation production valve having profiled grooving and seal bores therein for closing the valve after the valve has been opened for flow between the valve interior and exterior.

DESCRIPTION OF THE PREFERRED EMBODIMENT

Figure 1:
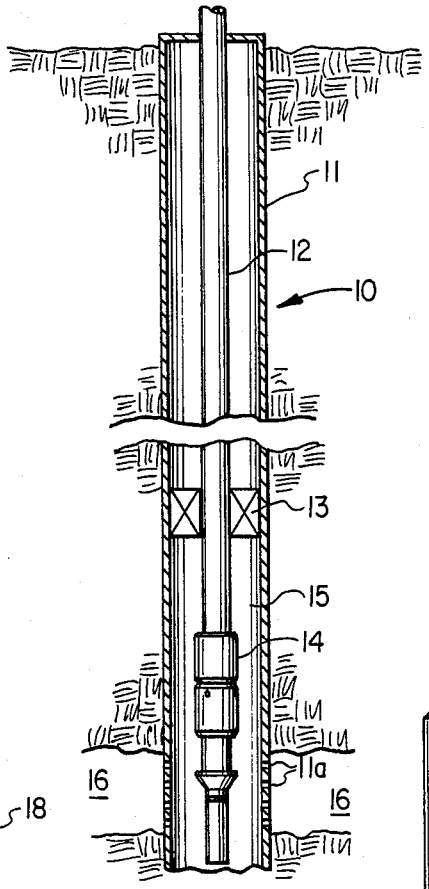
FIG. 1 is a schematic drawing of a well installation utilizing the well valve of this invention.

A well 10 is shown in FIG. 1 having a casing 11 therein. A string of tubing 12, having a closed lower end and carrying a packer 13 and a well valve of this invention 14 in closed position has been lowered into the well. The packer has been operated to anchor and seal in the casing forming a tubing casing annulus 15. The casing has perforations 11*a* communicating a producing formation 16 with the annulus 15. The closed valve 14 prevents pressure increases or pressure surges occurring in the tubing during well completion operations from being transmitted into the well annulus and formation and possibly damaging producing capabilities of the formation. After completing the well, valve 14 is opened to permit flow between the well annulus exterior of the valve to the interior of the valve and up the tubing to surface. When the valve is open, fluids may be pumped down the tubing through the open valve and injected into the formation if desired.

Figure 2:
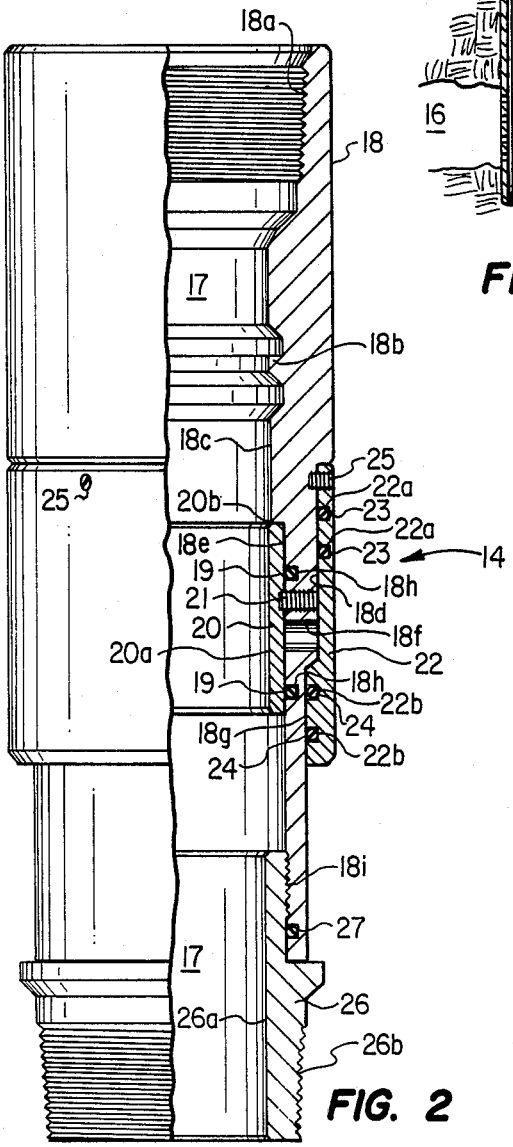
FIG. 2 is a half sectioned drawing of the invention well valve showing the internal and external sleeves in closed position.

FIG. 2 shows valve 14 having a through flow passage 17 and a body 18 having an upper connection 18*a* for connection on a tubing string. The body also has profiled grooving 18*b*, a seal bore 18*c*, an external sealing surface 18*d*, a bore 18*e*, at least one wall flow port 18*f* and anther external sealing surface 18*g*, which is smaller than external sealing surface 18*d*. Resilient seals 19 are housed in internal grooves 18*h* in the body above and below the port, sealing the sleeve 20 on equal diameters in the housing. Sleeve 20 is releasably positioned by shearable screw 21 closing the port 18*f* to flow from flow passage 17. Sleeve 20 has a bore 20*a* which is slightly smaller than seal bore 18*c* providing a landing shoulder 20*b* on the upper end of sleeve 20.

Slidably mounted on external sealing surfaces 18*d* and 18*g* is an external sleeve 22. This sleeve is sealed to larger external sealing surface 18*d* by resilient seals 23 in grooves 22*a* and to smaller external sealing surface 18*g* by resilient seals 24 in grooves 22*b*. The external sleeve is releasably positioned on the body by shearable screw 25, closing port 18*f* to flow from exterior of valve 14.

A connector 26 is connected to the body by thread 18*i* and is sealed to the body with a resilient seal 27. The body has a seal bore 26*a* and a lower connection 26*b* for the connection of well tubing below valve 14.

Figure 3:
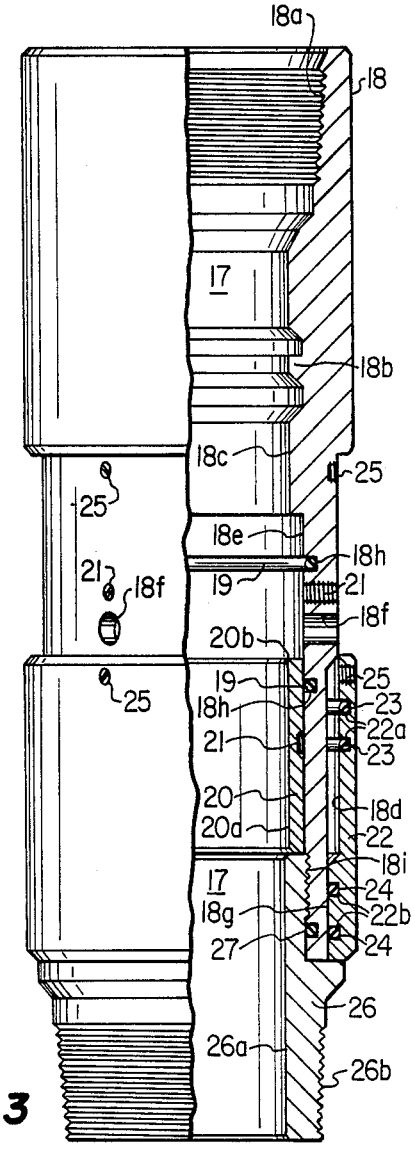
FIG. 3 is a half sectioned drawing of the well valve showing the internal and external sleeves in open position.

At any time during well completion operations, the invention valve 14, shown closed in FIG. 2, may be opened as shown in FIG. 3 by applying sufficient down force to landing shoulder 20*b* on sleeve 20 via a pumped down ball or weight to shear screw 21 and move this sleeve downwardly in bore 18*e* until the top of the sleeve is below upper resilient seal 19, opening port 18*f* to flow from valve interior flow passage 17 through port 18*f* into external sleeve 22. Pressure in sleeve 22 acts on the difference in sealed area between seal surfaces 18*d* and 18*g* tending to move the sleeve downwardly. When pressure in the valve interior and external sleeve 22 increases sufficiently to shear screw 25 and move upper resilient seal 23 below port 18*f*, flow may occur between valve interior flow passage 17 through port 18*f* and the valve exterior.

The open valve 14 may be later closed to flow between the valve interior and valve exterior by installing a lock mandrel in profiled grooving 18*b* carrying seals which seal in seal bores 18*c* and 26*a* above and below port 18*f*, closing the port to flow.

What I claim is:

1. The combination of a tubing string extending downwardly into casing in a well, a packer connected in said tubing, said packer anchoring said tubing in and sealing said tubing to said casing, a valve connected in said tubing below said packer and the lower end of said tubing closed to flow, said valve controlling the flow of fluid between the interior and exterior of said tubing, said valve including a tubular body having a flow passage therethrough and at least one flow port through said body wall, an internal sleeve having equal end areas sealed in said body, said sleeve not moveable by pressure in said body or said port acting on equal sealed areas, said sleeve being moveable downwardly from closed to open position to permit flow between the interior of said body and said port, and an external sleeve on said body moveable downwardly from closed to open position in response to pressure in said body port to permit flow through said port and between the interior and exterior of said valve.

2. The combination of claim 1 wherein the valve further includes means releasably positioning the internal sleeve in closed position.

3. The combination of claim 1 wherein the valve further includes means releasably positioning the external sleeve in closed position.

4. The combination of claim 1 wherein the valve body has profiled grooving and a seal bore therein above the flow port and a seal bore therein below said port.

5. The combination of claim 4 wherein the seal bore in the valve body above the flow pot is larger than the inside of the internal sleeve and the body seal bore below said flow port is smaller than the inside of said internal sleeve.

6. A valve connectible in well tubing comprising:

(a) a tubular body having a flow passage therethrough and at least one port through said body wall;

(b) pressure balanced means within said body including an internal sleeve having equal end areas sealed in said body, said sleeve not moveable by pressure in said body or said port acting on equal sealed areas, said sleeve being moveable downwardly from closed to open position to permit flow from the interior of said body through said port; and (c) unbalanced means on said body moveable downwardly from closed to open position in response to interior pressure in said body port to permit flow from the body interior through said port and between the interior and exterior of said body.

7. The valve of claim 6 wherein the balanced means further include resilient seals within the body above and below the port sealingly engaging the internal sleeve and means releasably positioning said internal sleeve in closed position.

8. The valve of claim 6 wherein the unbalanced means comprise:

(a) A sleeve slidably mounted and releasably positioned on the body, said sleeve having (b) resilient seals mounted therein sealingly engaging a larger diameter seal surface on said body above said port; and (c) resilient seals mounted in said sleeve sealingly engaging a smaller diameter seal surface on said body below said port.

9. The valve of claim 6 wherein the body includes profiled grooving and a seal bore therein above said port and a seal bore therein below said port.

10. The valve of claim 7 wherein the seal bore above the port is larger than the inside of the sleeve and the seal bore below the port is smaller than the inside of said sleeve.

11. A valve useful in well tubing for controlling flow between the interior and exterior of the tubing comprising:

(a) a tubular body having a through bore and at least one flow port through the body wall, said body adapted to be connected in well tubing;

(b) an internal sleeve having equal end areas sealed in said body, said sleeve not moveable by pressure in said body or said port acting on equal sealed areas, said sleeve being moveable downwardly from closed to open position to permit flow between the interior of said body and said port; and (c) an external sleeve moveable downwardly from closed to open position on said body in response to pressure in said body to permit flow through said port and between the valve body interior and exterior.

12. The valve of claim 11 wherein the body has resilient seals therein above and below the port sealingly engaging equal diameters on the internal sleeve and the external sleeve has resilient seals therein sealingly engaging the body on a larger diameter above the port and on a smaller diameter below the port.

13. The valve of claim 11 including means for releasably positioning the internal sleeve in closed position.

14. The valve of claim 12 wherein the means releasably positioning the internal sleeve in closed position is at least one shearable screw fastened in the body and said sleeve between the port and resilient seals above the port.

15. The valve of claim 11 including means for releasably positioning the external sleeve in closed position.

16. The valve of claim 15 wherein the means releasably positioning the external sleeve in closed position is a shearable screw fastened in said sleeve and the valve body above the resilient seals above the port.

17. The valve of claim 11 wherein the body further includes profiled grooving and a seal bore therein above the flow port and a seal bore therein below the flow port.

18. The valve of claim 17 wherein the seal bore in the body above the flow port is larger than the inside of the internal sleeve and the seal bore in the body below said port is smaller than the inside of said sleeve.

19. The combination of claim 2 wherein the means releasably positioning the internal sleeve in closed position is at least one shearable screw fastened in the valve body wall and internal sleeve above the port.

20. The combination of claim 3 wherein the means releasably positioning the external sleeve in closed position is at least one shearable screw fastened in the external sleeve and valve body above the port.

21. The valve of claim 7 wherein the means releasably positioning the internal sleeve in closed position is at least one shearable screw fastened in the valve body wall and internal sleeve between the port and seals above the port.

* * * * *